US010058127B2

(12) United States Patent
Liu

(10) Patent No.: US 10,058,127 B2
(45) Date of Patent: Aug. 28, 2018

(54) ELECTRONIC CIGARETTE

(71) Applicant: HUIZHOU KIMREE TECHNOLOGY CO., LTD. SHENZHEN BRANCH, Shenzhen, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days.

(21) Appl. No.: 15/118,505

(22) PCT Filed: Feb. 12, 2014

(86) PCT No.: PCT/CN2014/072008
§ 371 (c)(1),
(2) Date: Aug. 12, 2016

(87) PCT Pub. No.: WO2015/120592
PCT Pub. Date: Aug. 20, 2015

(65) Prior Publication Data

US 2017/0172207 A1 Jun. 22, 2017

(51) Int. Cl.
*A24F 13/00* (2006.01)
*A24F 47/00* (2006.01)

(52) U.S. Cl.
CPC ..... *A24F 47/008* (2013.01)

(58) Field of Classification Search
CPC ..... A24F 47/008
(Continued)

(56) References Cited

U.S. PATENT DOCUMENTS 8,156,944 B2 * 4/2012 Han ..... A24F 47/008 131/273
9,795,170 B1 * 10/2017 Zhu ..... A24F 47/008
(Continued)

FOREIGN PATENT DOCUMENTS

| | | | |
|---|---|---|---|
| CN | 103263083 | A | 8/2013 |
| CN | 203353691 | U | 12/2013 |
| CN | 203378559 | U | 1/2014 |

OTHER PUBLICATIONS

International Search Report of PCT Patent Application No. PCT/CN2014/072008 dated Jul. 8, 2014.

*Primary Examiner* — Khiem Nguyen

(57) ABSTRACT

The invention is related to an electronic cigarette, the electronic cigarette comprises an electronic cigarette body; the electronic cigarette body is provided with a smoking end, a tar storage device, an atomization assembly and a battery rod assembly; the tar storage device is arranged on one end of the electronic cigarette body away from the smoking end; a connection mechanism is arranged at the location where the atomization assembly and the tar storage device are connected with each other. Since the tar storage device is arranged on the end far away from the smoking end, a user can be effectively prevented from inhaling the non-atomized tobacco liquid and being hurt by heat generated by the atomization assembly; and furthermore, the tar storage device and the atomization assembly are mutually fastened and connected by the connection mechanism, thus the electronic cigarette is convenient in disassembly and assembly.

6 Claims, 7 Drawing Sheets

(58) Field of Classification Search
USPC ..... 131/329
See application file for complete search history.

(56) References Cited

U.S. PATENT DOCUMENTS 9,814,266 B2 * 11/2017 Liu ..... H05B 1/0244
9,814,267 B2 * 11/2017 Liu ..... A24F 47/008
9,814,272 B2 * 11/2017 Li ..... B67D 99/00

* cited by examiner

ELECTRONIC CIGARETTE

TECHNICAL FIELD

The present invention relates to electronic commodity, and more particularly relates to an electronic cigarette.

BACKGROUND

The structure of an electronic cigarette in prior art is shown in FIG. 1. The electronic cigarette in prior art comprises a suction nozzle 100, an atomization assembly 110 and a battery rod assembly 120. The suction nozzle 100, the atomization assembly 110 and the battery rod assembly 120 are in turn connected. The atomization assembly 110 is provided with a tar storage device 111 used for storing the tobacco liquid. The tar storage device 111 is provided with an oil guide cotton 112 and an electric heating wire assembly 113 used for atomizing the tobacco liquid. A smoke channel is formed inside the electronic cigarette to allow the users inhale the smoke atomized by the electric heating wire assembly 113.

In the electronic cigarette shown in FIG. 1, the tar storage device 111 is near the suction nozzle 100. And the tar storage device 111 locates inside the smoke channel, so the tobacco liquid in the tar storage device 111 is easy to leak into the smoke channel to make the users inhale non-atomized tobacco liquid.

SUMMARY

The technical problems that the present invention will solve is, aiming at the above-mentioned drawbacks, providing a prompted electronic cigarette.

The present invention provides an electronic cigarette, the electronic cigarette comprises:

an electronic cigarette body;

the electronic cigarette body is provided with a smoking end, a tar storage device for containing tobacco liquid, an atomization assembly for atomizing the tobacco liquid and a battery rod assembly for powering the atomization assembly;

the tar storage device is arranged on one end of the electronic cigarette body, and the end is far away from the smoking end; and a connection mechanism is arranged at where the atomization assembly and the tar storage device are connected with each other, the connection mechanism comprises a first connector and a second connect or which are mutually fastened and connected, the first connector is provided with a fastener, and the second connector is provided with a clamping groove matched with the fastener.

In the electronic cigarette case provided in the present invention, the first connector is provided with a inserting hole used for being inserted by the second connector, the fastener is arranged at an inner side wall of the inserting hole; the clamping groove is arranged at an outer side wall of the second connector.

In the electronic cigarette case provided in the present invention, the fastener is an annular bulge which is arranged radially along an inner circumferential wall of the inserting hole, the annular bulge encircles and forms a oval through hole;

a first end of the second connector toward the first connector is oval and matches with the oval through hole, the clamping groove is arranged radially along the outer side wall of the second connector;

when fastening, after the first end being through the oval through hole, the second connector is rotating to fasten the fastener in the clamping groove.

In the electronic cigarette case provided in the present invention, an end face of the second connector toward the first connector is provided with a convex part, the inserting hole is provided with a wavy elastic piece, the wavy elastic piece is used for preventing the fastener from sliding out of the clamping groove;

when the fastener is fastened in the clamping groove, the convex part abuts a concave part of the wavy elastic piece.

In the electronic cigarette case provided in the present invention, the first connector is provided with an inserting hole used for being inserted by the second connector, the clamping groove is arranged on an inner side wall of the inserting hole, the fastener is arranged on an outer side wall of the second connector; and the inserting hole is provided with a guide channel which matches with fastener and is used for guiding the fastener to enter the clamping groove.

In the electronic cigarette case provided in the present invention, a joint of the guide channel and the clamping groove is provided with an elastic limit part, the elastic limit part protrudes radially along the first connector, the elastic limit part is used for preventing the fastener from sliding out of the clamping groove.

In the electronic cigarette case provided in the present invention, the atomization assembly locates between the battery rod assembly and the tar storage device, and the smoking end locates outside at an end of the battery rod assembly or locates at middle part of the battery rod assembly or locates at a part of the battery rod assembly away from the atomization assembly.

In the electronic cigarette case provided in the present invention, the atomization assembly and the battery rod assembly are coaxially arranged.

In the electronic cigarette case provided in the present invention, the atomization assembly comprises:

an electric heating wire assembly used for atomizing the tobacco liquid;

an oil guide mechanism used for transporting the tobacco liquid in the tar storage device to the electric heating wire assembly.

In the electronic cigarette case provided in the present invention, the atomization assembly further comprises an atomization support and an atomization sleeve, the electric heating wire assembly is arranged in the atomization support, the oil guide mechanism is arranged in the atomization sleeve; the atomization sleeve and the atomization support are coaxially arranged and an end of the atomization sleeve is inserted in the tar storage device, a side wall of the atomization sleeve is provided with at least one oil inlet hole.

In the electronic cigarette case provided in the present invention, wherein, the oil guide mechanism is an oil guide cotton.

The beneficial effects of implementing the present invention compared to prior art are: As the tar storage device of the electronic cigarette provided in the present invention is arranged at an end of the electronic cigarette body far away from the smoking end, the electronic cigarette provided in the present invention can effectively prevent users from inhaling non-atomized tobacco liquid. The heat produced by the atomization assembly can be prevented from burning the users. And the connection mechanism is used for fastening the tar storage device and the atomization assembly, so assembly and disassembly are convenient.

BRIEF DESCRIPTION OF THE DRAWINGS

The invention will be further described with reference to the accompanying drawings and embodiments in the following.

DETAILED DESCRIPTION OF THE PREFERRED EMBODIMENT

In order to better understand the technical features, purpose and effect of the present invention, the preferred embodiment will be detailedly descried in the following.

Figure 1:
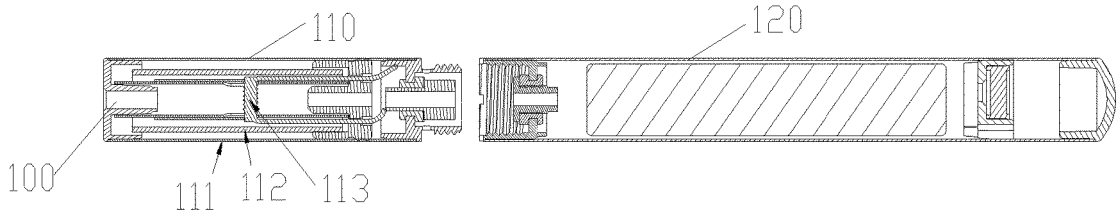
FIG. 1 is a structure schematic diagram of an electronic cigarette in prior art.
Figure 2:
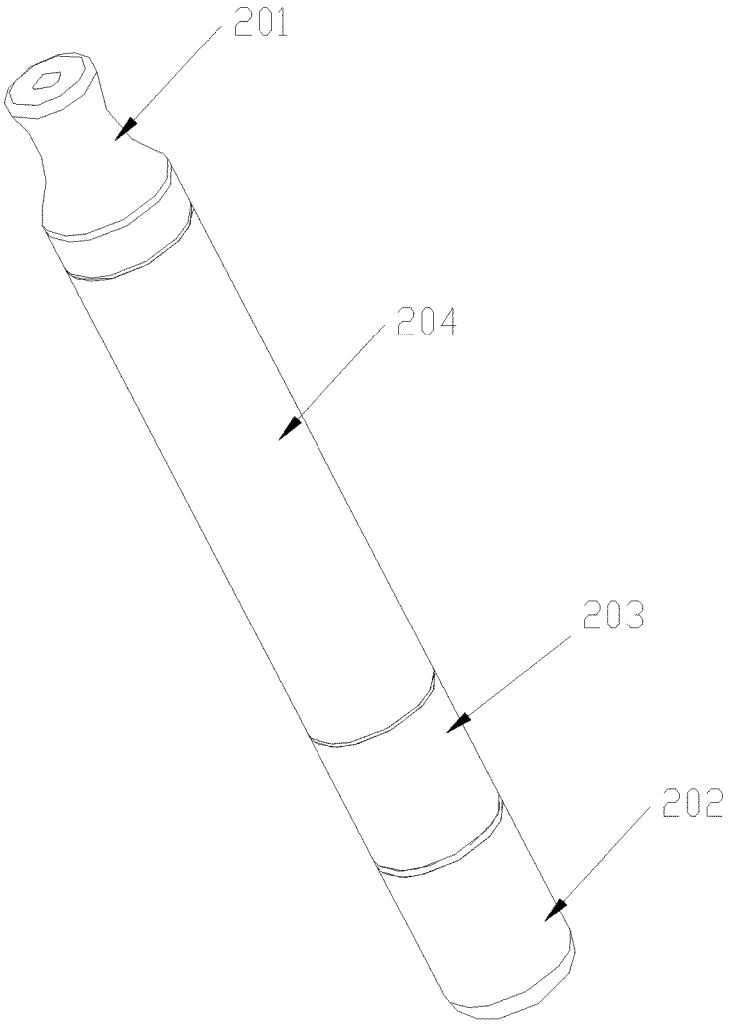
FIG. 2 is a three-dimensional structure schematic diagram of the electronic cigarette in an embodiment of the present invention.
Figure 3:
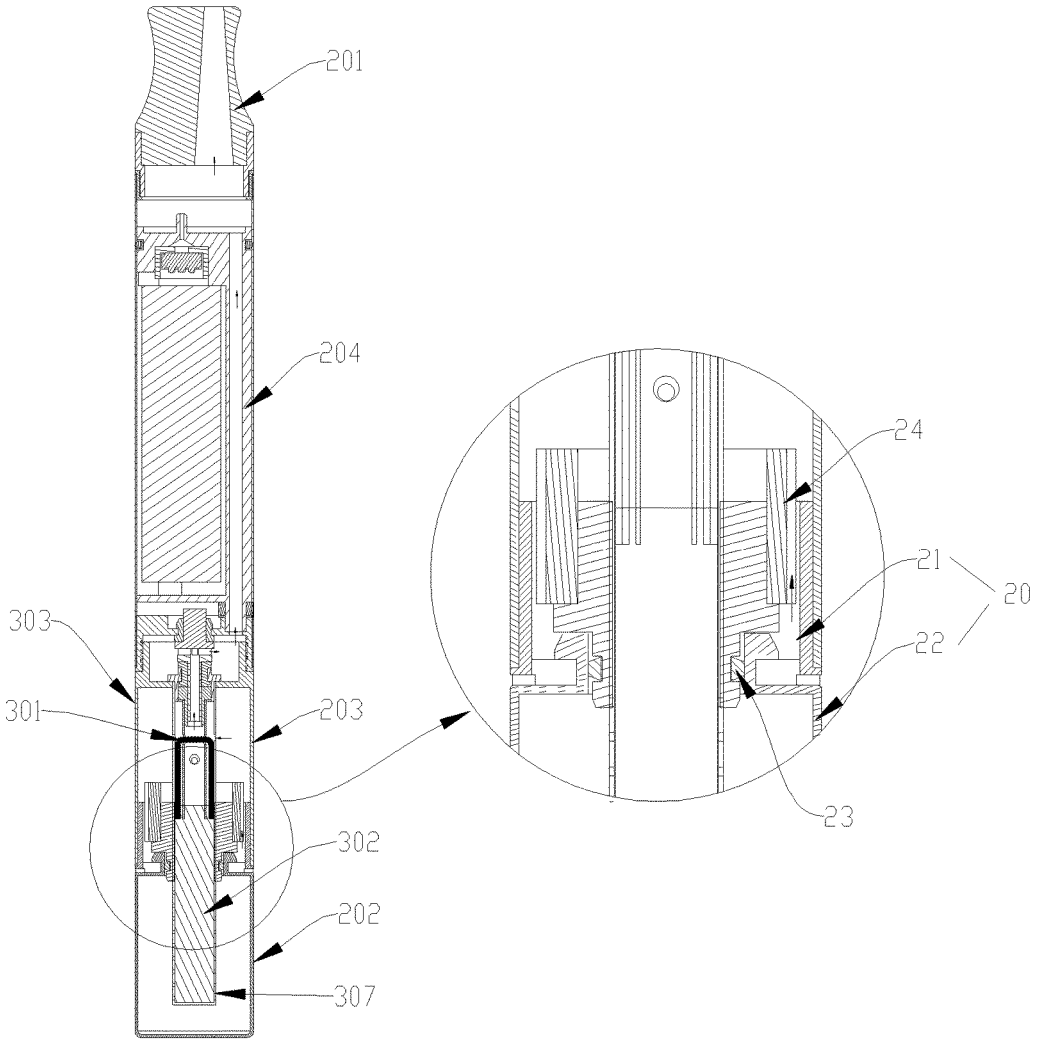
FIG. 3 is a section view of the electronic cigarette in the embodiment shown in FIG. 2.
Figure 4:
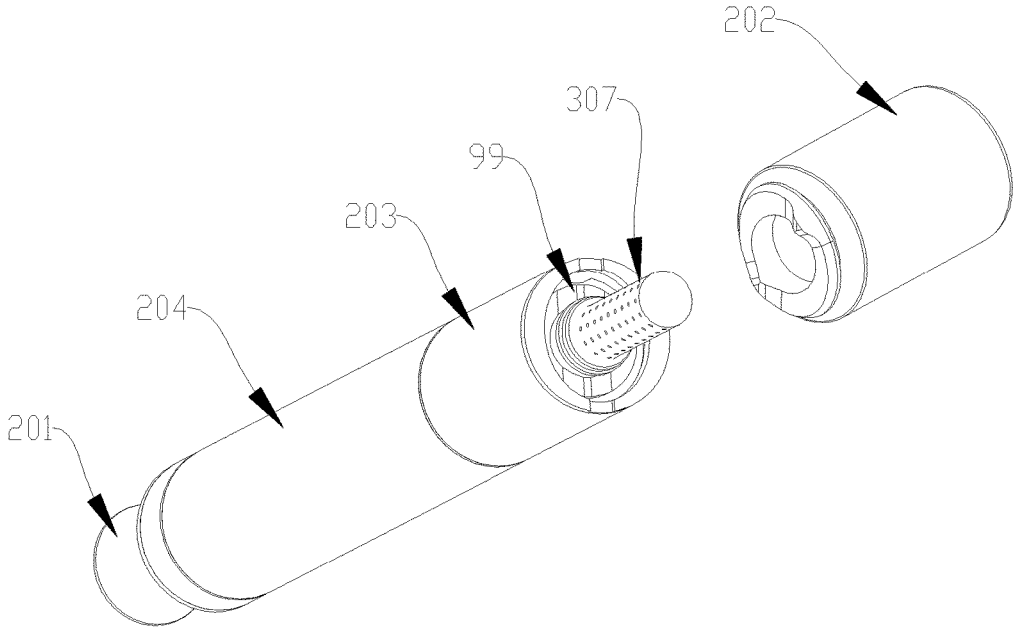
FIG. 4 is a three-dimensional breakdown structure schematic diagram of the electronic cigarette in the embodiment shown in FIG. 2.
Figure 5:
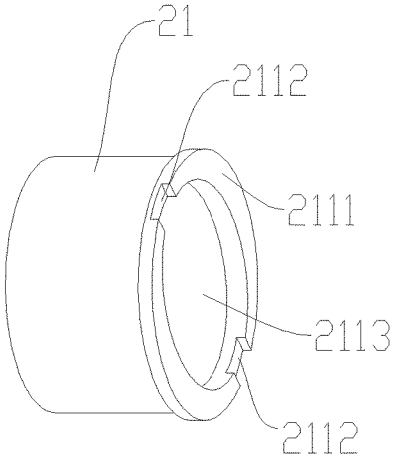
FIG. 5 is a three-dimensional structure schematic diagram of the first connector in the embodiment shown in FIG. 2.
Figure 6:
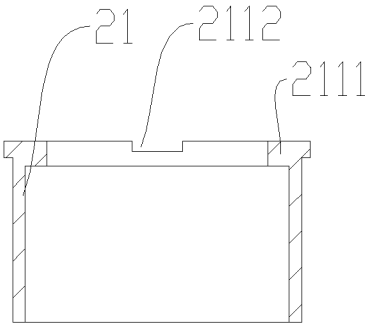
FIG. 6 is a front view of the first connector in FIG. 5.
Figure 7:
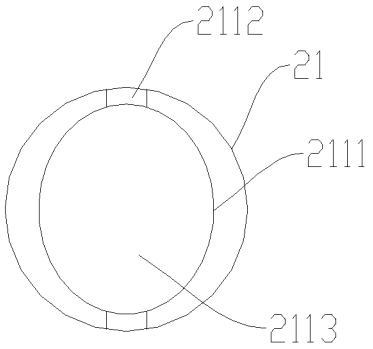
FIG. 7 is a top view of the first connector in FIG. 5.

As shown in FIG. 2 and FIG. 3, the electronic cigarette comprises:

- an electronic cigarette body, the electronic cigarette body is provided with a smoking end 201, users can inhale via the smoking end 201;
- a tar storage device 202 for containing tobacco liquid, the tar storage device 202 stores the tobacco liquid which can be atomized;
- an atomization assembly 203 for atomizing the tobacco liquid, the tobacco liquid in the tar storage device 202 can be atomized by the atomization assembly 203;
- a smoke channel used for the atomized tobacco liquid flowing is formed in the electronic cigarette body (not shown in the Figure), users can inhale the tobacco liquid in the smoke channel via the smoking end 201; and
- a battery rod assembly 204 for powering the atomization assembly 203.

Specifically, the tar storage device 202 is arranged on one end of the electronic cigarette body far away from the smoking end 201. The advantage of this arrangement is, as the tar storage device 202 is far away from the smoking end 201, the smoke channel in the electronic cigarette body will not pass the tar storage device 202, the non-atomized tobacco liquid in the tar storage device 202 will not leak into the smoke channel, users will not inhale the non-atomized tobacco liquid, so the leakage of the tobacco liquid can be prevented effectively. And the smoke can be prevented from condensation in the smoke channel to block the smoke channel. Also, the heat produced by the atomization assembly 203 can be prevented to affect the users' experience.

The atomization assembly 203 locates between the battery rod assembly 204 and the tar storage device 202, and the smoking end 201 locates outside at an end of the battery rod assembly 204 or locates at middle part of the battery rod assembly 204 or locates at the part of the battery rod assembly 204 far away from the atomization assembly 203.

Specifically, the smoking end 201 which locates outside at an end of the battery rod assembly 204 and the battery rod assembly 204 can be coaxially arranged. Applying this arrangement can make the electronic cigarette simulate the real cigarette.

Or the smoking end 201 locates at middle part of the battery rod assembly 204 or locates at the part of the battery rod assembly 204 far away from the atomization assembly 203. Applying this arrangement can reduce the oil accumulation effectively.

In the present invention, the location of the smoking end 201 is not limited.

In this embodiment, in order to make the overall structure of the electronic cigarette to simulate the real cigarette and conform to users' habit, the atomization assembly 203 and the battery rod assembly 204 can be coaxially arranged.

Specific arrangement is not limited in the embodiment, for example, the battery rod assembly 204, the atomization assembly 203 and the tar storage device 202 which are in turn connected can be staggered, making the electronic cigarette an unusual shape, the unusual shape can be any shape.

Moreover, the atomization assembly 203 and the battery rod assembly 204 can be not coaxially arranged. The tar storage device 202 and the atomization assembly 203 can be parallelly arranged, which makes the tar storage device 202 and the atomization assembly 203 are connected to the battery rod assembly 204 respectively. The overall structure of the electronic cigarette is T-shape.

In this embodiment, the overall shape of the electronic cigarette is not limited, as long as the tar storage device 202 is arranged far away from the smoking end 201.

In this embodiment, the atomization assembly 203 locates between battery rod assembly 204 and the tar storage device 202, the atomization assembly 203 is far away from the smoking end 201. When users use the electronic cigarette provided in this embodiment to smoke, the atomization assembly 203 is far away from the users' mouth. The heat produced by the tobacco liquid atomized by the atomization assembly 203 will not burn the users, the safety can be effectively promoted. And users can hold the battery rod assembly 204 to smoke when smoking, users do not need to hold the hot atomization assembly 203. The electronic cigarette provided in this embodiment will not burn the users' hand. The temperature of the electronic cigarette is effectively simulated. The users' experience is promoted when smoking.

The preferred one is that the atomization assembly 203 and the battery rod assembly 204 can be detachably connected.

As shown in FIG. 3, the atomization assembly 203 comprises: an atomization support 303, an oil guide mechanism 302, an atomization sleeve 307 and an electric heating wire assembly 301.

The atomization support 303 is a circular tube structure, the top of the atomization support 303 is provided with a thread structure detachably connected with the battery rod assembly 204. The atomization sleeve 307 and the atomization support 303 are coaxially arranged. The atomization assembly 203 further comprises an atomization electrode fixedly arranged in the thread structure. An insulation ring is arranged between the thread structure and the atomization electrode. The atomization electrode and the electric heating wire assembly 301 are electrically connected. The electric heating wire assembly 301 can atomize the tobacco liquid.

The oil guide mechanism 302 is used for transporting the tobacco liquid in the tar storage device 202 to the electric heating wire assembly 301 to atomize. Specifically, the oil guide mechanism 302 can apply the oil guide cotton. And the oil guide mechanism 302 is arranged in the atomization sleeve 307. Specifically, the atomization sleeve 307 is inserted in the tar storage device 202. At least one oil hole is arranged at the circumferential wall of the atomization sleeve 307. The tobacco liquid in the tar storage device 202 can be transported to the oil guide mechanism 302 via the oil hole.

As shown in FIGS. 4-7, in this embodiment, the first connector 21 is approximately a cylindrical structure, the first connector 21 is interference fitted at the inner side of an end of the atomization support 303 far away from the battery rod assembly 204. The first connector 21 is provided with an inserting hole 2113 used for being inserted by the second connector 22. The inner side wall of the inserting hole 2113 is provided with the fastener 2111. The inserting hole 2113 is coaxially provided with a connecting base support 24, the connecting base support 24 is provided with a circular groove. There is a sealing ring 23 in the groove. The sealing ring 23 can be made by rubber. The inner side wall of the second connector 22 is elastic abutted against the sealing ring 23.

Figure 8:
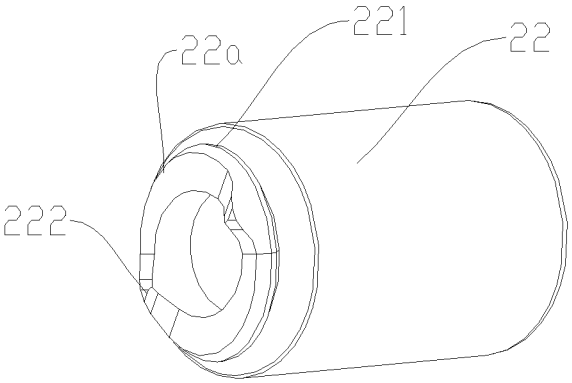
FIG. 8 is a three-dimensional structure schematic diagram of the tar storage device equipped with the second connector in the embodiment shown in FIG. 2.
Figure 9:
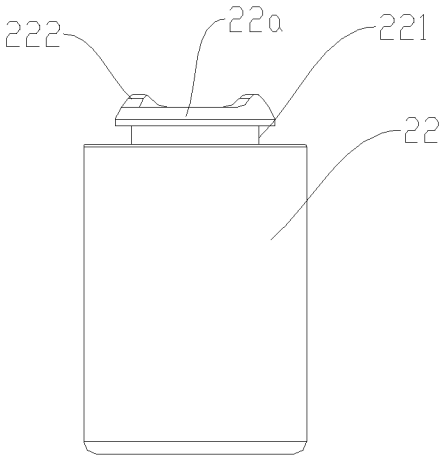
FIG. 9 is a front view of the three-dimensional structure schematic diagram shown in FIG. 8.
Figure 10:
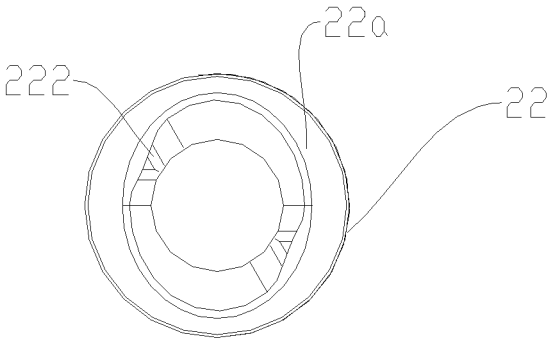
FIG. 10 is a top view of the three-dimensional structure schematic diagram shown in FIG. 8.

As shown in FIGS. 8-10, the second connector 22 is arranged at the opening of the tar storage device 202 and is tubulous. The second connector 22 is connected to the interior of the tar storage device 202. The outer side wall of the second connector 22 is provided with the clamping groove 221.

Further, in this embodiment, the fastener 2111 is an annular bulge which is arranged radially along the inner circumferential wall of the inserting hole 2113. The annular bulge encircles and forms a oval through hole (not labeled). The first end 22*a* of the second connector 22 toward the first connector 21 is oval and matches with the oval through hole. The clamping groove 221 is arranged radially along the outer side wall of the second connector 22 and is near the first end 22*a*. And an end face of the second connector 22 toward the first connector 21 is provided with two convex parts 222, the inserting hole 2113 is provided with a wavy elastic piece 90, the wavy elastic piece 90 is used for preventing the fastener 2111 from sliding out of the clamping groove 221. When fastening, after the first end 22*a* is through the through hole, rotate the second connector 22 to fasten the fastener 2111 in the clamping groove 221. The convex part 222 is abutted against the concave part of the wavy elastic piece 99.

Figure 11:
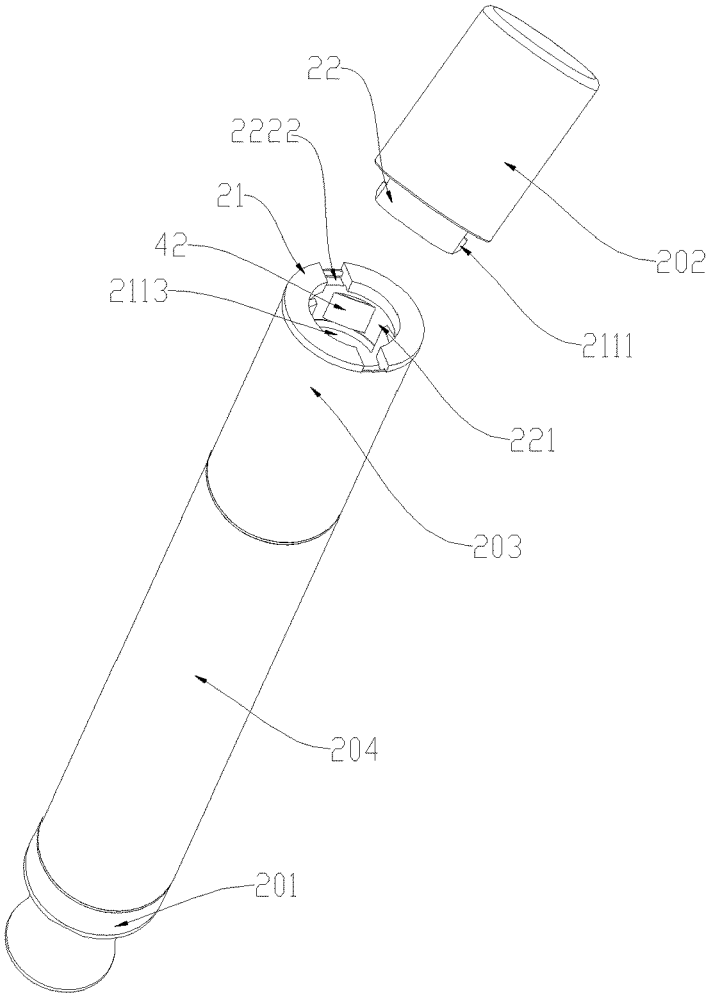
FIG. 11 is a three-dimensional structure schematic diagram of the electronic cigarette in another embodiment.
Figure 12:
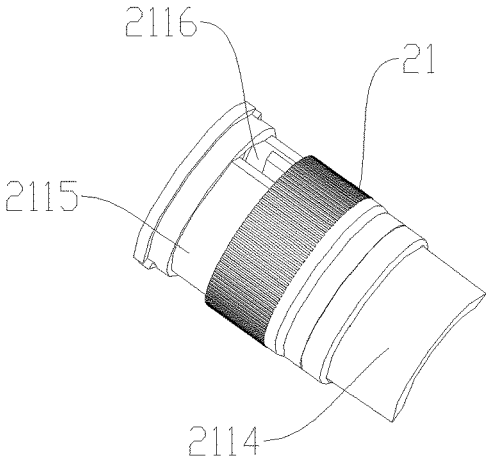
FIG. 12 is a three-dimensional structure schematic diagram of the first connector of the electronic cigarette in the embodiment shown in FIG. 11.

As shown in FIG. 11 and referred to FIG. 12, in another embodiment of the present invention, the first connector 21 is approximately a cylindrical structure, the first connector 21 is interference fitted at the inner side of an end of the atomization support 303 far away from the battery rod assembly 204. The second connector 22 is also a cylindrical structure, and is arranged at the opening of the tar storage device 202. The second connector 22 is connected to the interior of the tar storage device 202. The first connector 21 is provided with an inserting hole 2113 used for being inserted by the second connector 22. The difference between this embodiment and the first embodiment is, the inner side wall of the inserting hole 2113 is provided with the clamping groove 221. And the fastener 2111 is arranged at the outer side wall of the second connector 22. There are two fasteners 22. The two fasteners 22 are symmetrically arranged at outer side wall of second connector 22 near the first connector 21. The inserting hole 2113 is provided with a guide channel 2222 which matches with fastener 2111 and is used for guiding the fastener 2111 to enter the clamping groove 221. And the guide channel 2222 is connected to the atomization channel. as the smoke inlet hole.

Figure 13:
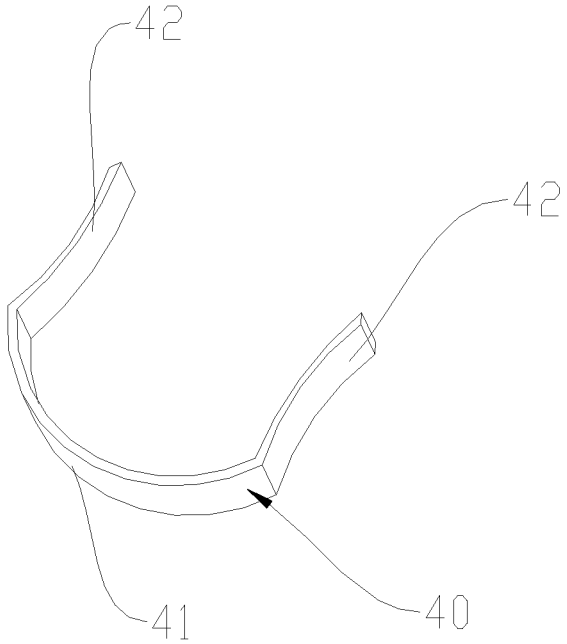
FIG. 13 is a three-dimensional structure schematic diagram of the elastic component of the electronic cigarette in the embodiment shown in FIG. 11.

Further, as shown in FIG. 12, the outer side wall of the first connector 21 is provided with an annular groove 2115. Two ends of the annular groove 2115 are provided with the through hole 2116 respectively. The first connector 21 further comprises an elastic component 40. Referred to FIG. 13, the elastic component 40 comprises a connection part 41 which is arc-shaped and an elastic limit part 42 connected to the two ends of the connection part 41. The shape of the connection part 41 matches with the annular groove 2115. The connection part 41 is fastened in the annular groove 2115. The two elastic limit parts 42 extends in the interior of the first connector 21 through the two through holes 2116 respectively. The two elastic limit parts 42 protrude radially along the first connector 21. The two elastic limit parts 42 locate at the joint of the clamping groove 221 and the guide channel 2222. The elastic limit part 42 is used for preventing the fastener 2111 from sliding out of the clamping groove 221, and then preventing the tar storage device 202 from falling off the atomization assembly 203.

Further, in order to let the users know the remaining value of the tobacco liquid in the tar storage device 202, the tar storage device 202 is a transparent container. The users can know the remaining value of the tobacco liquid in the tar storage device 202 at any time. It is convenient for the users to replace the tar storage device 202.

A better one is that the tar storage device 202 is a glass bottle.

A much better one is that the outer side wall of the glass tar storage device 202 is provided with scale. So the users can estimate the remaining value of the tobacco liquid.

And in order to simulate the cigarette, the length of the electronic cigarette is generally same as the cigarette. And in order to reduce the charging frequency and increase the working life of the battery rod assembly 204, the length of the battery rod assembly 204 can be at least half of the length of the electronic cigarette. When users use the electronic cigarette in this embodiment, users will hold the smoking end 201 which is the upper part of the electronic cigarette. As the tar storage device 202 in this embodiment is arranged at an end far away from the smoking end 201, the clamping force of tar storage device 202 is same. The force-balanced tar storage device 202 will transport balance tobacco liquid to the atomization assembly 203 to effectively ensure the stabilization of the smoke.

Combining with the accompanying drawings, embodiments of the present invention are described. However, the present invention is not limited by the above embodiments, which means that the above specific embodiments are only schematic, rather than restrictive. It should be understood that, in the inspiration of the present invention, those skilled in the art who appreciate and realize all or part of the process in above embodiments may make many modifications or alternatives, without going beyond the purpose and the scope the claims intend to protect of the present application. All these belong to the protection of the present invention.

What is claimed is:

1. An electronic cigarette, wherein, the electronic cigarette comprises:

an electronic cigarette body;

the electronic cigarette body is provided with a smoking end (201), a tar storage device (202) for containing tobacco liquid, an atomization assembly (203) for atomizing the tobacco liquid and a battery rod assembly (204) for powering the atomization assembly (203);

wherein the tar storage device (202) is arranged on one end of the electronic cigarette body, and the end is away from the smoking end (201); and wherein a connection mechanism (20) is arranged at where the atomization assembly (203) and the tar storage device (202) are connected with each other, the connection mechanism (20) comprises a first connector (21) and a second connector (22) which are mutually fastened and connected, the first connector (21) is provided with a fastener (2111), and the second connector (22) is provided with a clamping groove (221) matched with the fastener (2111);

wherein the first connector (21) is provided with an inserting hole (2113) used for being inserted by the second connector (22), the fastener (2111) is arranged at an inner side wall of the inserting hole (2113); the clamping groove (221) is arranged at an outer side wall of the second connector (22);

wherein the fastener (2111) is an annular bulge which is arranged radially along an inner circumferential wall of the inserting hole (2113), the annular bulge encircles and forms an oval through hole;

wherein a first end (22*a*) of the second connector (22) toward the first connector (21) is oval and matches with the oval through hole, the clamping groove (221) is arranged radially along the outer side wall of the second connector (22);

when fastening, after the first end (22*a*) being through the oval through hole, rotate the second connector (22) to fasten the fastener (2111) in the clamping groove (221); and wherein an end face of the second connector (22) toward the first connector (21) is provided with a convex part (222), the inserting hole (2113) is provided with a wavy elastic piece (90), the wavy elastic piece (90) is used for preventing the fastener (2111) from sliding out of the clamping groove (221);

when the fastener (2111) is fastened in the clamping groove (221), the convex part (222) abuts a concave part of the wavy elastic piece (90).

2. The electronic cigarette according to claim 1, wherein the atomization assembly (203) locates between the battery rod assembly (204) and the tar storage device (202), and the smoking end (201) locates outside at an end of the battery rod assembly (204) or locates at middle part of the battery rod assembly (204) or locates at a part of the battery rod assembly (204) away from the atomization assembly (203).

3. The electronic cigarette according to claim 1, wherein the atomization assembly (203) and the battery rod assembly (204) are coaxially arranged.

4. The electronic cigarette according to claim 1, wherein the atomization assembly (203) comprises:

an electric heating wire assembly (301) used for atomizing the tobacco liquid;

an oil guide mechanism (302) used for transporting the tobacco liquid in the tar storage device (202) to the electric heating wire assembly (301).

5. The electronic cigarette according to claim 4, wherein the atomization assembly (203) further comprises an atomization support (303) and an atomization sleeve (307), the electric heating wire assembly (301) is arranged in the atomization support (303), the oil guide mechanism (302) is arranged in the atomization sleeve (307); the atomization sleeve (307) and the atomization support (303) are coaxially arranged and an end of the atomization sleeve (307) is inserted in the tar storage device (202), a side wall of the atomization sleeve (307) is provided with at least one oil inlet hole.

6. The electronic cigarette according to claim 5, wherein the oil guide mechanism (302) is an oil guide cotton.

* * * * *